United States Patent [19]

Wallis

[11] 4,292,869

[45] Oct. 6, 1981

[54] UNITARY PUNCH AND DIE ASSEMBLY

[76] Inventor: Bernard J. Wallis, 25200 Trowbridge Ave., Dearborn, Mich. 48124

[21] Appl. No.: 141,678

[22] Filed: Apr. 18, 1980

[51] Int. Cl.[3] ..... B21D 45/00; B26D 7/00; B26F 1/00

[52] U.S. Cl. ..... 83/137; 83/169; 83/389; 83/390

[58] Field of Search ..... 83/137, 389, 390; 72/427; 83/169

[56] References Cited

U.S. PATENT DOCUMENTS 2,716,451 8/1955 Taylor ..... 83/137

2,732,898 1/1956 Taylor ..... 83/137

*Primary Examiner*—J. M. Meister

*Attorney, Agent, or Firm*—Barnes, Kisselle, Raisch & Choate

[57] ABSTRACT

A unitary punch and die assembly wherein the stripper spring for the punch comprises a fluid cylinder which communicates with a gas reservoir formed integrally with the punch and die holder and which is adapted to be charged with gas to a predetermined pressure so as to obtain a desired stripping force on the punch. The hold down sleeve on the punch is preferably also actuated by a fluid spring to obtain a preselected clamping force on the stock being punched.

18 Claims, 6 Drawing Figures

UNITARY PUNCH AND DIE ASSEMBLY

This invention relates to a unitary punch and die assembly of the type used in a punch press or a press brake for hole punching and notching in metal stock.

The conventional type of unitary punch and die assembly to which the present invention relates is in the form of a generally C-shaped yoke or holder wherein a punch and a hold down are mounted for vertical reciprocation on the upper jaw of the holder and an apertured die button is mounted on the lower jaw or anvil of the holder. In such a conventional arrangement the hold down is in the form of a sleeve telescopically arranged around the shank of the punch. A heavy spring is arranged between the upper end of the punch and the hold down and a lighter spring is arranged between the upper end of the hold down and the upper face of the upper jaw of the holder through which the punch and hold down extend.

In such an arrangement the lighter spring normally retains the lower end of the hold down projecting downwardly beyond the leading lower end of the punch so that, when the punch descends, the hold down engages and clamps the stock down against the die button before the punch engages the stock. The heavy spring is utilized for stripping the workpiece off the end of the punch when the punch retracts to its fully raised position.

Several problems are ever present in such arrangements where mechanical springs are utilized. When punching relatively thick stock the spring acting between the hold down and the punch must, of necessity, be relatively heavy and large in order to strip the workpiece off the end of the punch. As a consequence, oversized springs are frequently employed to positively insure stripping of the stock from the punch. The use of springs heavier than necessary is objectionable because these springs have to be compressed on the punching stroke and the press in which the assembly is used is thus unnecessarily excessively loaded. In addition, the operation of changing springs from one size to another is time consuming. Furthermore, the selection of a spring size only sufficiently adequate to exert the required pressure is, at best, an inaccurate guess on the part of the press set-up personnel because of the difficulty involved in accurately calibrating springs.

The present invention has for its primary object the avoidance of the above-mentioned problems by having the punch biased upwardly by gas pressure rather than by a mechanical spring.

A more specific object of this invention is to provide a unitary punch and die assembly wherein the punch is secured to a piston slideably arranged in a vertically extending cylinder in the punch holder which is connected to a source of gas under pressure. The gas pressure is readily adjustable to a selected value which is only sufficiently high to assure stripping of the stock from the end of the punch.

Another object of this invention is to provide a unitary punch and die assembly wherein a gas-operated piston cylinder is utilized for retracting the punch and wherein the piston cylinder arrangement, as well as the gas pressure source for operating it, are housed entirely within the holder for the punch and die.

A further object of the invention is to provide a punch and die assembly of the type described wherein both the clamping force and the stripping force on the hold down and on the punch are obtained by gas pressure.

Other objects, features and advantages of the present invention will become apparent from the following description and accompanying drawings, in which.

Figure 1:
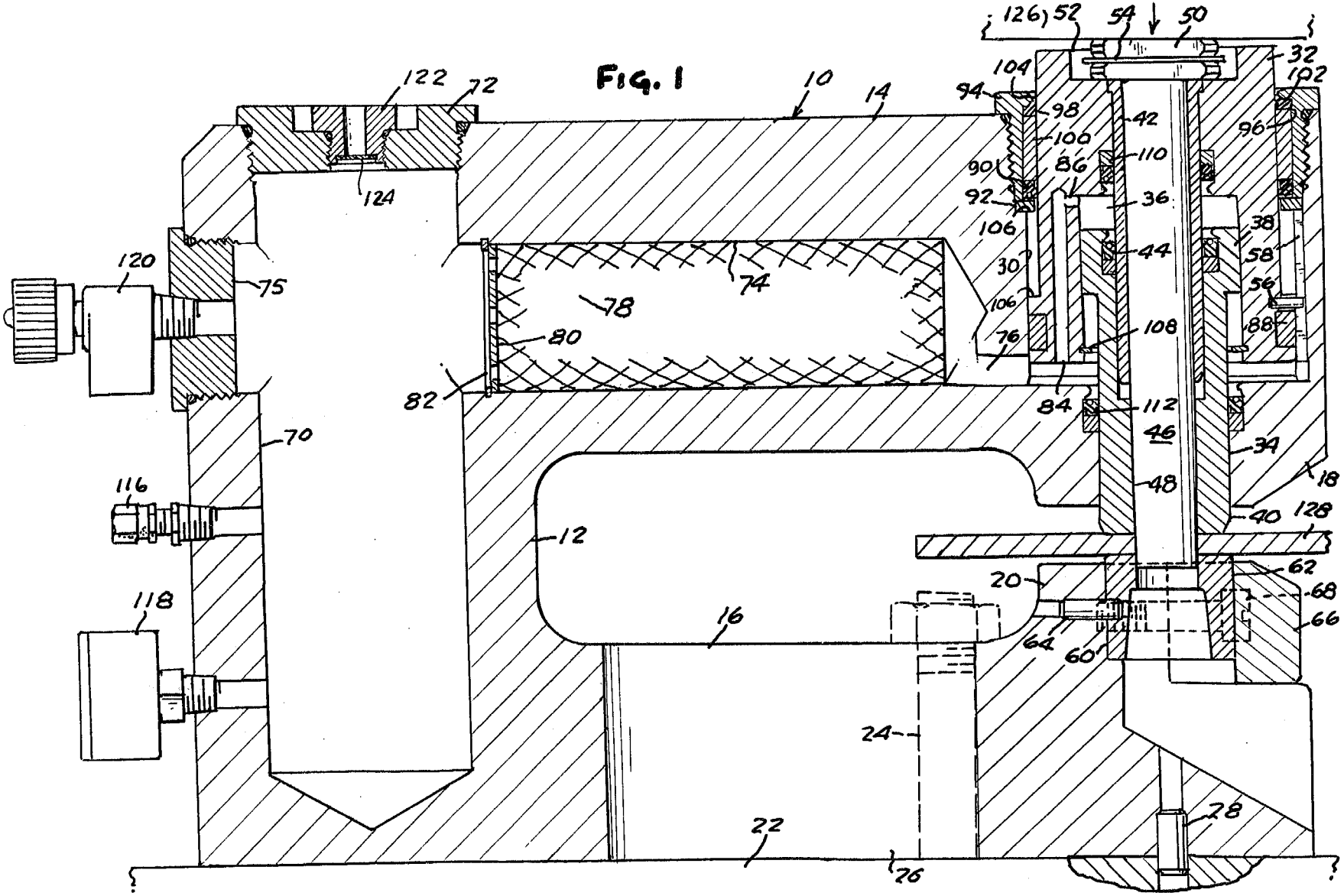
FIG. 1 is a vertical sectional view through a unitary punch and die assembly according to the present invention, the punch being illustrated at the lower end of its stroke.

Referring to FIG. 1 there is illustrated a punch and die holder 10 in the form of a casting of generally C-shape in vertical section. Holder 10 comprises a bight portion 12 having laterally extending upper and lower arms 14,16, respectively, which terminate in a pair of vertically opposed upper and lower jaws 18,20, respectively. Holder 10 is adapted to be supported on the bed 22 of a press and securely clamped thereto by means of a clamping screw 24 which extends through an elongate slot 26 in the lower arm 16 of the holder. If desired, holder 10 may be accurately located on the bed 22 by means of a pilot pin 28.

The upper jaw 18 of holder 10 has a large diameter vertical bore 30 extending to the upper face thereof which forms a cylinder for a piston 32. The upper jaw 18 is also provided with a smaller bore 34 concentric with and extending downwardly from the lower end of bore 30. The under side of piston 32 is formed with a bore 36 that forms a cylinder for a piston 38. Piston 38 comprises the upper end of a hold down sleeve 40 which is of smaller diameter than the piston so that the top side of piston 38 has a larger area than the under side thereof.

Figure 4:
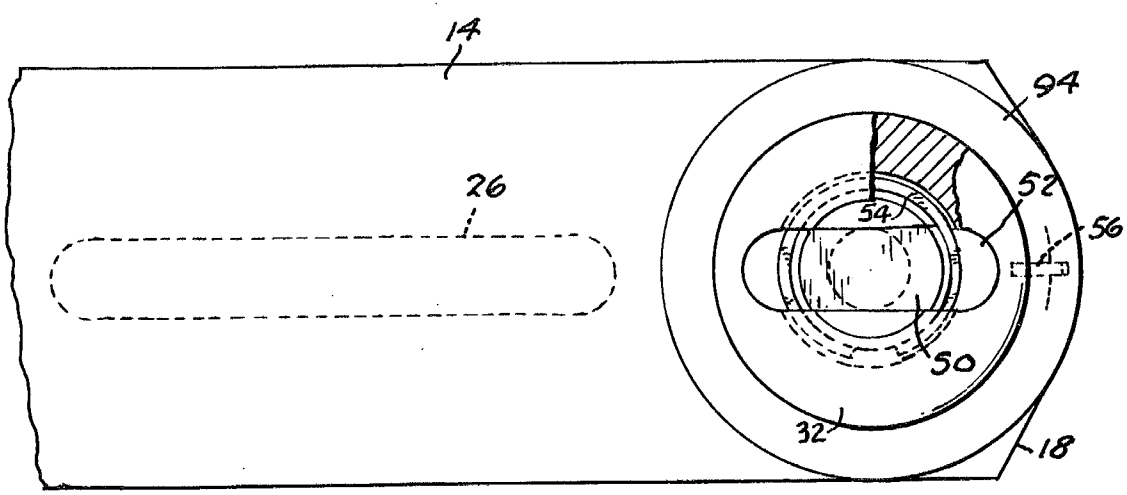
FIG. 4 is a fragmentary top view, partly in section, of the assembly.

Within piston 32 there is arranged a bearing sleeve 42 which extends downwardly through cylinder 36 and is slideably engaged by piston 38 and hold down sleeve 40. A fluid tight connection between piston 38 and the outer periphery of bearing sleeve 42 is effected by an annular seal 44. The shank of a punch 46 extends downwardly through bearing sleeve 42 and a concentric bore 48 in the lower portion of hold down sleeve 40. The head 50 of punch 46 is seated in an elongated socket 52 at the upper end of piston 32 and is releasably locked therein by a snap ring 54. Thus, punch 46 is constrained to move vertically with piston 32. As is best shown in FIG. 4, the punch head 50 is elongated and is seated in slot 52 so that the punch is prevented from rotating within piston 32. Piston 32 is, in turn, prevented from rotating relative to the upper jaw 18 by means of a pin 56 on the piston which engages a vertical slot 58 at one side of bore 30.

The lower jaw 30 of the holder is formed with a socket 60 in which a die button 62 is seated. Die button 62 is securely retained in the lower jaw by means of a dowel pin 64 and a clamp 66 secured to the lower jaw by screws 68. The die opening in button 62 registers axially with the leading lower end of punch 46.

The bight portion 12 of the holder 10 is provided with a large diameter vertical bore 70, the upper end of which is closed by a threaded cap 72. A horizontally extending bore 74 in the upper arm 14 of the holder extends transversely across the upper end portion of the bore 70 and is closed at one end thereof by threaded cap 75. The opposite end of bore 74 is connected by a passageway 76 with the lower end portion cylinder 30. Within bore 74 there is disposed a wick or sponge 78 which is saturated with lubricant and which is retained within the bore by an apertured disc 80 held in place by a snap ring 82.

Piston 32 is formed with a passageway 84 extending upwardly from the lower face thereof and communicating with the upper end of bore 36 as at 86. The piston is guided for vertical movement in bore 30 by an annular bearing 88 and is sealed within bore 30 by means of an annular seal 90. Seal 90 is located within bore 30 directly above a washer 92 and adjacent the lower end of a bushing 94 which is threaded into the upper end of bore 30. Adjacent its upper end bushing 94 is formed on the under side thereof with a recess 96 in which a resiliently compressible wiper 98 is seated. An annular spacer bearing 100 extends vertically between the upper face of seal 90 and the lower face of wiper 98. The fluid pressure against the lower face of seal 90 causes the seal to expand into sealing engagement with the inner periphery of bushing 94 and the outer periphery of piston 32. At the same time, this fluid pressure displaces seal 90 upwardly and through spacer bearing 100 compresses wiper 98 so that the conical wall 102 of recess 96 causes the conical flange 104 to be displaced radially inwardly into effective sealing engagement with the outer periphery of piston 32. With this arrangement an effective wiping action of the piston is obtained even though the outer periphery thereof may wear down over a long period of time.

The extent to which piston 32 can move upwardly within bore 30 is limited by the interengagement of a shoulder 106 on the piston with washer 92 which is held in place by bushing 94. The extent to which hold down sleeve 40 can shift downwardly relative to piston 32 is determined by the interengagement of the under side of piston 38 with a snap ring 108 retained within the lower end of bore 36. A fluid tight connection between bearing sleeve 42 and piston 32 is obtained by an annular seal 110 and a fluid tight connection between hold down sleeve 40 and bore 34 in the upper jaw 18 is obtained by an annular seal 112. It will be observed that slot 58 not only prevents piston 32 from rotating within cylinder bore 30, but also forms a passageway which establishes communication between the lower end of cylinder bore 30 and the portion thereof above shoulder 106 on piston 32.

The unit is adapted to be charged with gas, such as nitrogen, to a predetermined pressure by connecting the valve filler stem 116 with a pressurized gas tank. The pressure within the unit is indicated by a pressure gauge 118 and can be reduced to the value desired for the particular operation being performed by a manual bleed valve 120. The unit is protected from being charged to an excessively high pressure by means of a safety plug 122 having a disc 124 therein designed to rupture at a predetermined high value. The selected pressure to which the unit is charged is just sufficient to strip the punch from the strip stock being worked upon as hereinafter described.

Figure 2:
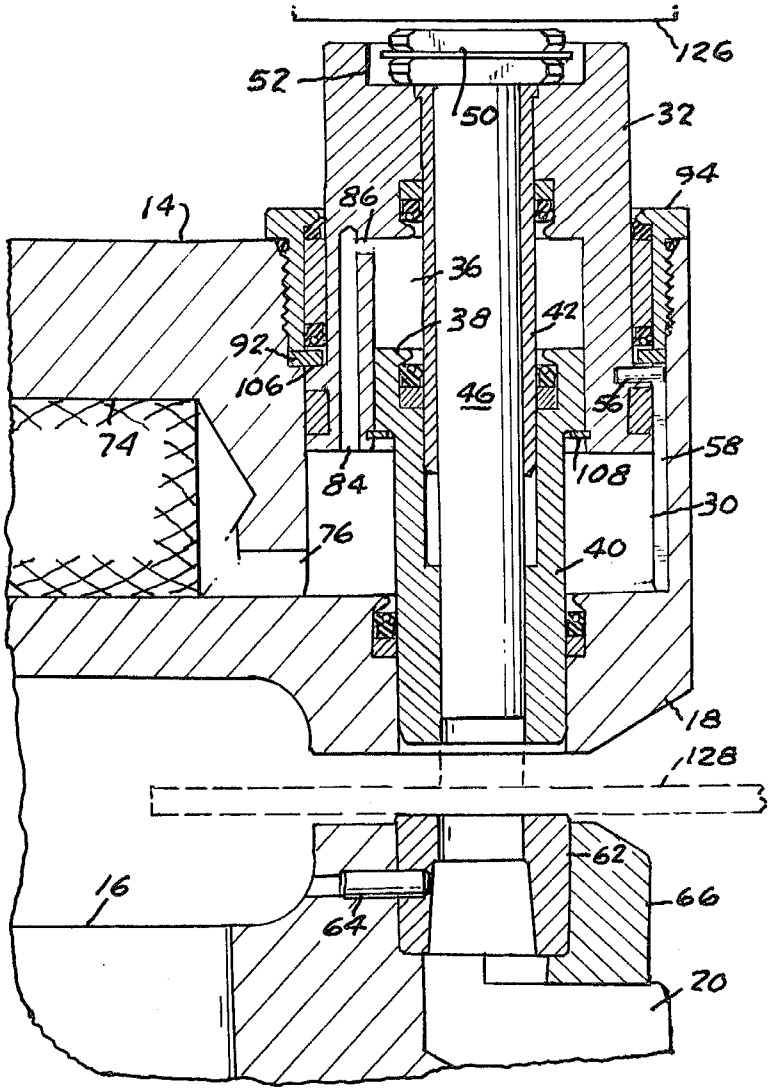
FIG. 2 is a fragmentary sectional view similar to FIG. 1 and showing the punch retracted to the upper end of its stroke.

When the unit is initially charged the components thereof assume the positions illustrated in FIG. 2. The pressure on the under side of piston 32 displaces it upwardly in cylinder bore 30 until shoulder 106 abuts the washer 92. At the same time this pressure is directed to the top side of piston 38 by passageways 84,86 so that the hold down sleeve 40 is displaced downwardly in cylinder bore 36 until the under side of piston 38 engages the snap ring 108. In this condition of the assembly the head 50 of punch 46 either engages or is spaced slightly below the upwardly retracted ram 126 of the press in which the assembly is installed.

The strip stock 128 to be punched is inserted between the jaws 18,20 of the holder so that it rests upon die button 62. The press is then actuated so that ram 126 descends and engages the head 50 of the punch 46. When this occurs, piston 32 is displaced downwardly in cylinder 30 and, since the leading end of the punch is located at least slightly above the lower end of hold down sleeve 40, the hold down sleeve engages the workpiece 128 and clamps it against the top face of die button 62 before the workpiece is engaged by the leading end of the punch. The clamping force exerted by the hold down sleeve 40 against the workpiece is determined by the pressure to which the unit is charged and the differential area between the top and under sides of piston 38. After the hold down sleeve 40 engages the work, continued downward movement of piston 32 causes punch 46 to pierce a hole in the workpiece 128 as shown in FIG. 1.

In FIG. 1 the ram 126 has descended to its fully lowered position. When ram 126 is retracted upwardly the pressure on the top side of piston 38 will retain hold down sleeve 40 in clamping relation with the workpiece while the punch 46 is being retracted therefrom. This prevents the workpiece from being elevated with the punch. The unit is initially charged to a pressure which is adequate to retain the hold down sleeve 40 in clamping relation with the workpiece until the leading end of the punch 46 is completely stripped therefrom. As the punch continues to retract vertically upwardly piston 38 at the upper end of hold down sleeve 40 is progressively displaced downwardly relative to the upwardly moving piston 30 until the under side of piston 38 is engaged by the snap ring 108 on piston 32 and the components again assume the position shown in FIG. 2.

It will be appreciated that, although piston 32 and piston 38 provide fluid springs, the entire unit is self-contained and, during operation, need not be connected to a source of fluid pressure. In addition, it will be observed that the cylinders in which these two pistons reciprocate are isolated completely from the surrounding atmosphere and therefore the surrounding atmosphere is not drawn into and expelled from the cylinder in response to reciprocation of the pistons. Furthermore, in the event that the upper end portion of piston 32 becomes worn through continued use, the pressure on the under side of annular seal 90 maintains wiper 98 in compression and causes the annular lip 104 of the wiper to be maintained in effective wiping relation with the outer periphery of the piston. In addition, it will be appreciated that by incorporating the lubricant impregnated sponge 78 in cylinder bore 74, whenever piston 32 retracts upwardly the gas flowing from the reservoir defined by the bore 70 into the cylinder bore 30 entrains lubricant as it flows through sponge 78 and thus provides lubrication for the working parts of the piston and cylinders over an extended period of time.

Figure 6:
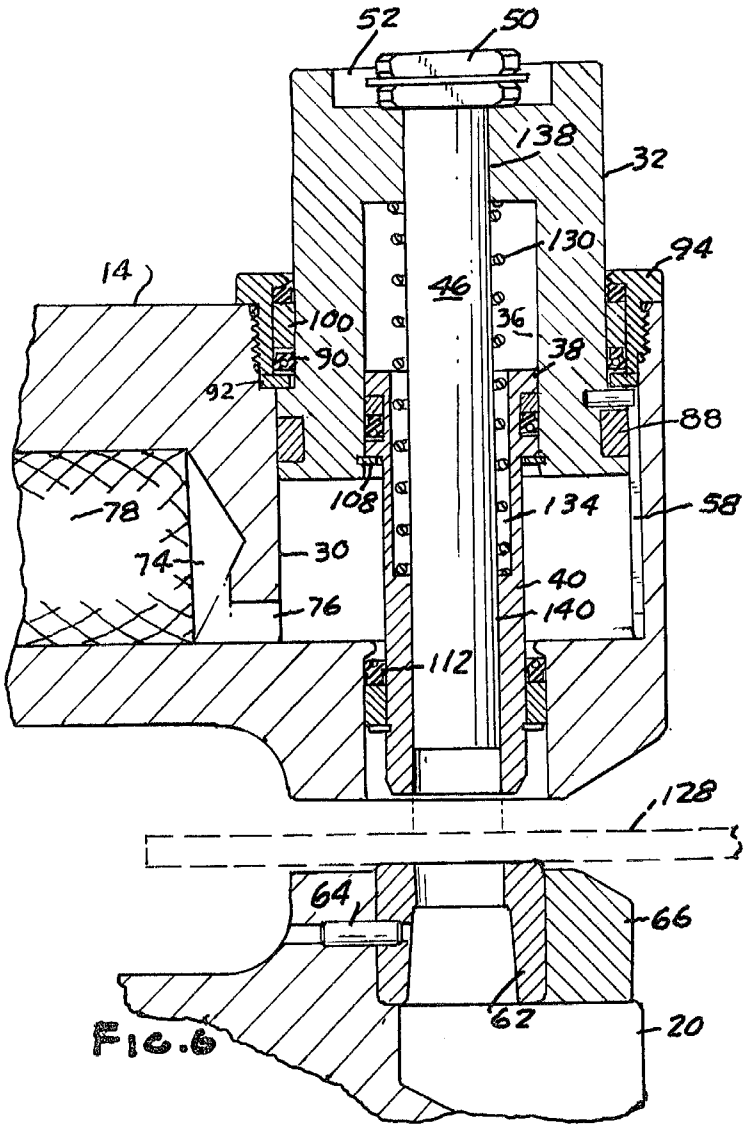
FIG. 6 is a fragmentary sectional view of the modification shown in FIG. 5 with the punch in its raised retracted position.
Figure 3:
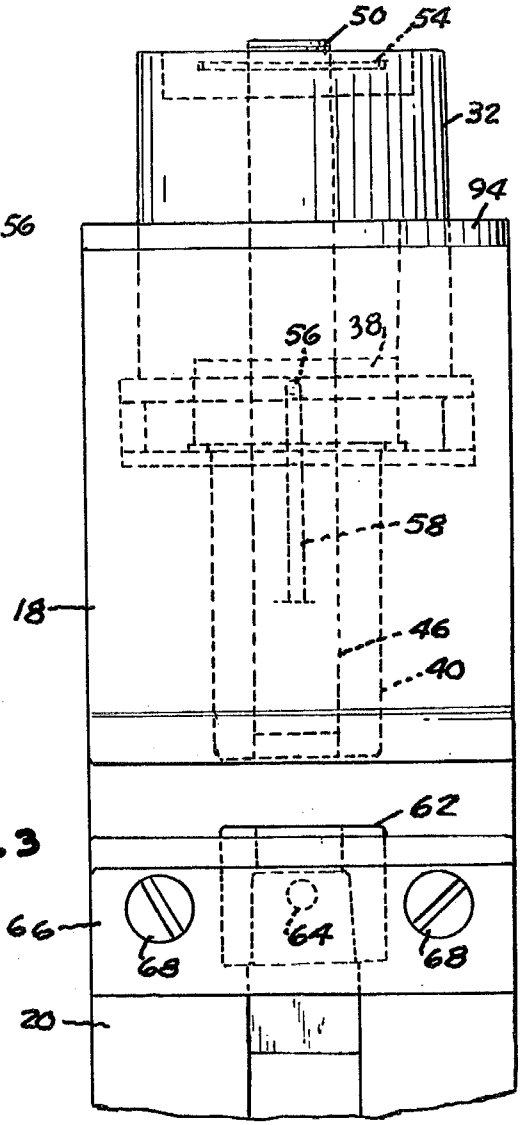
FIG. 3 is a fragmentary front elevational view of the assembly shown in FIGS. 1 and 2.
Figure 5:
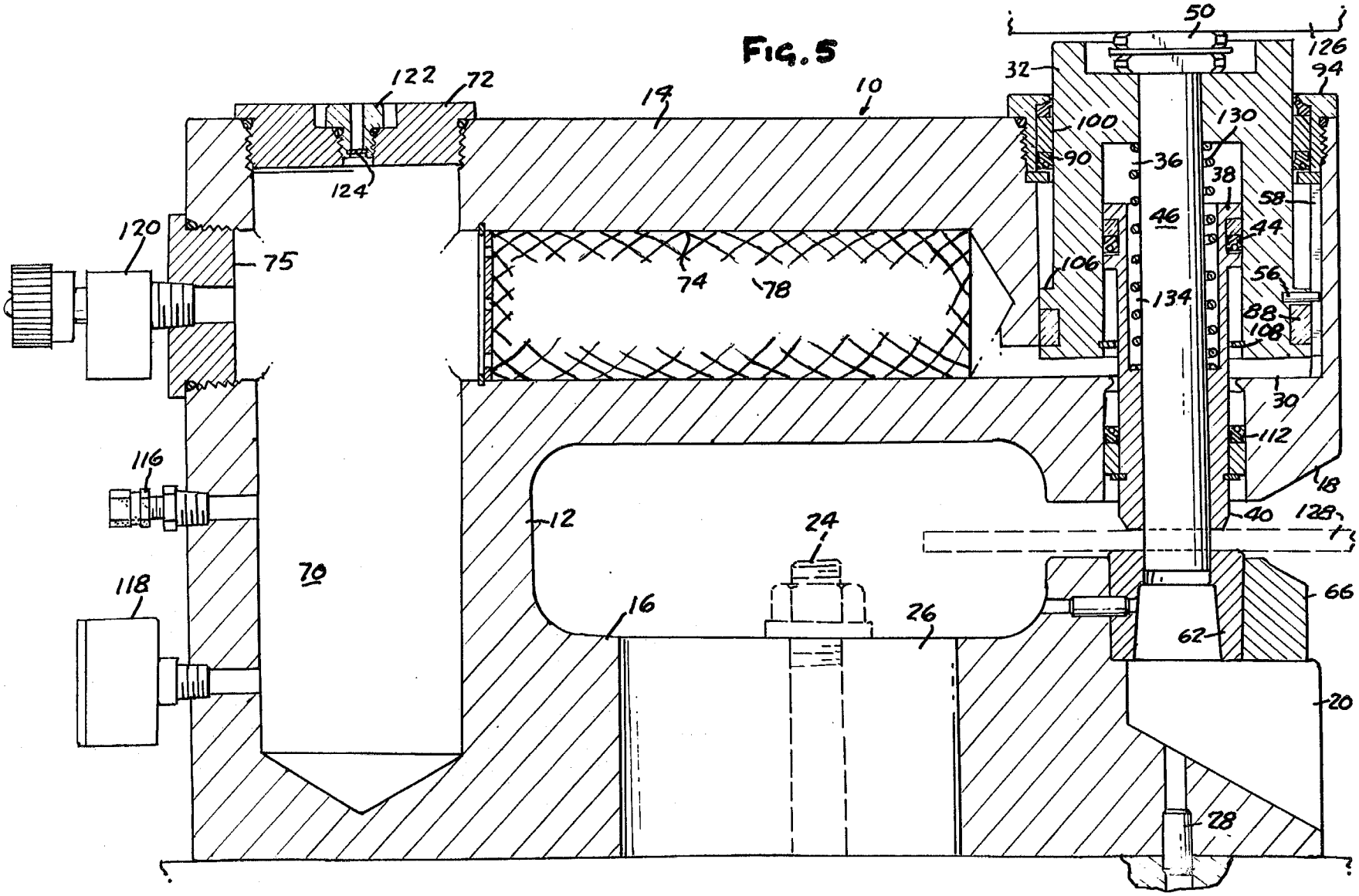
FIG. 5 is a view similar to FIG. 1 and showing a modified form of punch and die assembly according to this invention.

The modified arrangement shown in FIGS. 5 and 6 differs from the arrangement shown in FIGS. 1 through 4 essentially in only one respect. In the modified arrangement a compression spring 130 is arranged between the upper end of cylinder 36 and the lower end of a counterbore 134 in hold down sleeve 40. The upper end of the punch is not sealed with respect to piston 32 and therefore the portion of cylinder 36 above piston 38 communicates with the surrounding atmosphere through the slight clearance between the upper end portion of the punch shank and the bore 138 in piston 32 through which the punch extends. The portion of cylinder 36 above piston 38 also communicates with the surrounding atmosphere through the slight clearance space between the lower end of the punch shank and the bore 140 through the hold down sleeve 40 which reciprocates on the punch shank.

The operation of the modified form of punch and die assembly shown in FIGS. 5 and 6 is substantially the same as that previously described with the exception however that the clamping force exerted by the hold down sleeve 40 on the workpiece is determined exclusively by the strength of spring 130 rather than by fluid pressure acting on the upper side of piston 38. If desired, spring 130 can be relatively light and only sufficient to insure that the hold down sleeve 40 will engage the workpiece before the leading end of the punch. In the event that spring 130 does not exert sufficient force to strip the punch from the workpiece upon initiation of the retraction of piston 32, the workpiece will be lifted until it engages the lower face of upper jaw 18 and, thereafter, as piston 32 continues to retract upwardly, the workpiece will be effectively stripped from the end of the punch. Thus, with this arrangement, if spring 130 is not relied upon to strip the workpiece from the punch, then the unit is charged to a pressure such that the force exerted by the pressurized gas against the under side of piston 32 will be sufficient to strip the workpiece from the punch.

In the preferred embodiment illustrated and described the holder is provided with the gas reservoir which is adapted to be charged to a selected pressure. It will be appreciated, however, that, if desired, the unitary punch and die assembly can also be connected to a remotely located source of high pressure gas by a hose or other conduit.

I claim:

1. A unitary punch and die assembly comprising a generally C-shaped holder having a pair of vertically opposed jaws at one side thereof, the lower jaw having a die button secured thereon, the upper jaw having a vertical bore therein defining a main cylinder the lower end portion of which is adapted to be connected to a source of gas under pressure, said upper jaw having a smaller diameter bore concentric with the main cylinder and extending downwardly from the lower end of the main cylinder through the lower end of said upper jaw, a main piston arranged for vertical sliding movement in said main cylinder and projecting upwardly through the upper end thereof, a punch secured to said main piston to move vertically therewith and extending downwardly through said main piston and said smaller bore in vertical alignment with said die button, said main piston having a vertical bore on the under side thereof which defines an auxiliary cylinder, a hold down sleeve slideably arranged on said punch and extending downwardly through said main cylinder and said smaller bore, the upper end of said hold down sleeve forming an auxiliary piston slideably arranged within said auxiliary cylinder, said auxiliary piston having an outer diameter larger than the outer diameter of the lower end portion of the sleeve so that the sleeve is biased upwardly on the punch by the pressure of the gas acting against the under side of the auxiliary piston, means acting between the main piston and said hold down sleeve and biasing said sleeve downwardly on the punch with a force greater than that exerted against the under side of the auxiliary piston by the gas pressure in said cylinder such that the lower end of the sleeve normally extends downwardly below the leading end of the punch, interengageable abutment means on said main and auxiliary piston for limiting the extent of downward movement of said sleeve relative to the punch and for lifting the sleeve with the punch when the abutments are interengaged whereby, when a downward force is applied to the upper end of the punch which is of sufficient magnitude to overcome the pressure exerted by the gas against the under side of the main piston, the punch and sleeve descend as a unit until the lower end of the sleeve engages and clamps a workpiece down on said die button and, thereafter, the punch continues to move downwardly to punch the workpiece and when said downward force on the upper end of the punch is relieved, the pressure of the gas in said main cylinder raises the punch and, upon interengagement of said abutments, lifts the hold down sleeve with the punch.

2. A punch and die assembly as called for in claim 1 wherein said biasing means are designed to apply a sufficient clamping force downwardly on the workpiece to strip the workpiece from the punch when the punch is raised.

3. A punch and die assembly as called for in claim 1 wherein said biasing means comprises a compression spring.

4. A punch and die assembly as called for in claim 1 wherein the top side of the auxiliary piston has an area greater than the under side thereof and said biasing means includes a passageway extending between the upper end of the auxiliary cylinder and said main cylinder whereby the clamping force with which the lower end of the hold down sleeve engages the workpiece is proportional to the gas pressure in said cylinder.

5. A punch and die assembly as called for in claim 1 including means for nonrotatably connecting the punch with said main piston and for preventing said main piston from rotating within said main cylinder.

6. A punch and die assembly as called for in claim 1 including means for varying the pressure of the gas in said cylinders.

7. A punch and die assembly as called for in claim 1 wherein said holder is formed with a reservoir for pressurized gas communicating with said cylinders, said reservoir having a volume substantially greater than the displacements of said main and auxiliary pistons as they shift vertically through their respective cylinders, said reservoir having a gas inlet valve thereon adapted to be removably connected to a source of gas under pressure to charge the reservoir and cylinders with gas at a preselected pressure.

8. A punch and die assembly as called for in claim 7 including means on said reservoir for adjusting the pressure of the gas therein.

9. A punch and die assembly as called for in claim 7 wherein said reservoir is disposed internally of said holder.

10. A punch and die assembly as called for in claim 9 wherein said holder has a generally vertically extending bight portion on the side thereof laterally opposite said jaws, said reservoir including a vertically extending bore in said bight portion, the upper end of said bore being closed by a plug.

11. A punch and die assembly as called for in claim 10 wherein said holder has an arm extending laterally from said bight portion to said upper jaw, said reservoir including a bore in said arm extending laterally from the bore in the bight portion to said upper jaw.

12. A punch and die assembly as called for in claim 11 wherein said bight portion has a plugged opening therein aligned axially with said lateral bore on the opposite side of the bore in the bight portion, said plugged opening having a diameter at least as large as the diameter of the lateral bore.

13. A punch and die assembly as called for in claim 11 including a gas pervious, lubricant impregnated member in said lateral bore through which the gas is constrained to flow to said main cylinder.

14. A punch and die assembly as called for in claim 1 including an annular seal between the auxiliary piston and the auxiliary cylinder and another annular seal between the outer periphery of the hold down sleeve and said smaller bore.

15. A punch and die assembly as called for in claim 1 wherein said biasing means includes a passageway means extending from the under side of said main piston to the upper end portion of the auxiliary cylinder so that the pressure of said gas is exerted against the top side of the auxiliary piston, the cross sectional area of the top side of the auxiliary piston being greater than the cross sectional area of the under side of the auxiliary piston.

16. A punch and die assembly as called for in claim 15 including a bearing sleeve extending downwardly through said main piston, said punch extending through said bearing sleeve with a close fit, the upper end portion of said bearing sleeve having a counterbore therein in which the lower end portion of said bearing sleeve is slideably engaged and including annular seals between the outer periphery of the bearing sleeve and said main and auxiliary pistons.

17. A punch and die assembly as called for in claim 16 including abutment means adapted to interengage and thereby limit the extent to which the hold down sleeve is permitted to move downwardly relative to said punch and to lift said hold down sleeve with the punch when the punch is retracted vertically and said abutments are interengaged.

18. A punch and die assembly as called for in claim 16 including a bushing within the upper end of said main cylinder, said bushing having a recess around the inner periphery thereof adjacent its upper end, said recess having an upper wall portion that inclines radially inwardly and upwardly, a compressible wiper in said recess having a lip inclined radially inwardly and upwardly and engaging the inclined wall portion of the recess and means responsive to the pressure of the gas in said main cylinder for compressing said wiper such that said lip is displaced inwardly into wiping engagement with the outer periphery of said piston.

* * * * *